United States Patent [19]

Newbold

[11] Patent Number: 4,836,149

[45] Date of Patent: Jun. 6, 1989

[54] ROTATING CYLINDER BLOCK PISTON-CYLINDER ENGINE

[75] Inventor: Vernon D. Newbold, Fort Collins, Colo.

[73] Assignee: Future Power Inc., Greeley, Colo.

[21] Appl. No.: 178,649

[22] Filed: Apr. 7, 1988

[51] Int. Cl.[4] ..... F02B 57/06; F02B 57/08

[52] U.S. Cl. ..... 123/44 R; 123/44 C

[58] Field of Search ..... 60/624; 91/491; 123/44 C, 44 D, 44 R

[56] References Cited

U.S. PATENT DOCUMENTS

| | | | |
|---|---|---|---|
| 4,019,324 | 4/1977 | Coxon | 60/624 |
| 4,077,365 | 3/1978 | Schlueter | 123/44 D X |
| 4,078,529 | 3/1978 | Warwick | 60/624 X |
| 4,300,487 | 11/1981 | Triulzi | 123/44 D X |

FOREIGN PATENT DOCUMENTS

| | | | |
|---|---|---|---|
| 819041 | 10/1951 | Fed. Rep. of Germany | 91/491 |
| 466159 | 2/1913 | France | 123/44 C |

*Primary Examiner*—Ira S. Lazarus
*Assistant Examiner*—David G. Messer
*Attorney, Agent, or Firm*—Wenderoth, Lind & Ponack

[57] ABSTRACT

A rotating cylinder block piston-cylinder engine has a stator, a hollow rotor housing rotatably mounted on the stator means for rotation around a rotor housing axis of rotation, a plurality of cylinders radially positioned in the peripheral wall of the hollow rotor housing, a piston slidable in each of the cylinders and having a piston rod rigidly mounted thereon and extending radially of the rotor into the hollow rotor housing, a fuel supply connected to the cylinders and the pistons for supplying gaseous fuel into the cylinders which is caused to expand for driving pistons radially inwardly in the cylinders and for exhausting the exhaust gas from the cylinders, a rotatable reaction member in the hollow rotor housing and rotatably mounted on the stator for rotation around a fixed axis offset from the rotor housing axis of rotation and having radially spaced peripherally extending rolling engagement surface around the periphery thereof, and a differential rolling engagement device on the inner ends of each of the piston rods in engagement with the respective rolling engagement surfaces for transmitting the force from the pistons to the reaction member and reaction force from the reaction member to the pistons and for causing the reaction member to rotate.

19 Claims, 4 Drawing Sheets

ROTATING CYLINDER BLOCK PISTON-CYLINDER ENGINE

The present invention relates to a rotating cylinder block piston-cylinder engine which has a cylinder block in the form of a rotor in which the cylinders are located, and in which the pistons slidable in the cylinders have piston rods rigid therewith and which are engaged with a rotatable reaction member in the center of the rotor which is eccentric to the axis of rotation of the rotor. More particularly, the piston rods of the pistons are engaged with the rotatable reaction member by a differential rolling engagement means for transmitting the force from the pistons to the reaction member, and the reaction force from the reaction member to the pistons for causing the rotor to rotate and for causing the reaction member to rotate.

BACKGROUND OF THE INVENTION

Rotating cylinder block piston-cylinder engines are known, but the most common type is the type in which the piston rods are pivotably connected by crank pins to the piston, and rotatably connected to a fixed eccentric crank shaft, so that as the pistons are driven inwardly in the cylinders, the piston rods, as the rotor rotates and the reaction force is transmitted to the rotor, oscillate back and forth transverse to the axis of movement of the pistons. This common type is simply the reverse of a conventional radial piston-cylinder engine in which the cylinders are radially positioned in a fixed cylinder block around a conventional crank shaft and the pistons are connected to crank shaft by conventional oscillating piston rods.

The disadvantage of this common type of rotating cylinder block engine is that the forces which are set up by the oscillating piston rods at high rotational speeds are detrimental to the operation and the structure of the engine, requiring robust parts, and causing considerable wear and breakage of parts, similar to a conventional rotary engine.

There have been two proposals for a rotating cylinder block piston-cylinder engine similar to that of the present invention having piston rods rigid with the pistons. The first of these is disclosed in U.S. Pat. No. 1,445,474 to Benson et al., in which the cylinder block 5 is a rotor rotatably mounted around a shaft, and pistons 7 are reciprocal in cylinders in the rotor, and the piston rods from the cylinders engage a reaction member 4 which is eccentrically mounted on the shaft 3 through rollers 9. The rollers are held against the eccentric portion 4 by a ring 10 therearound. A similar engine is disclosed in British Patent No. 425278 of 1935, in the name of James Ferguson Edington. The Edington patent discloses a motor similar to that of Benson et al., but in which the engagement of the piston rods with the eccentric portion d is through sliders f which slide in a groove in the eccentric reaction member.

In both of these motors, the problem of the oscillating connecting rods is overcome, since the rods extending from the pistons are rigid with the pistons and reciprocate radially of the axis about which the rotor rotates. However, in both of these engines, the engagement of the piston rods with the reaction member is through a means which will generate great amounts of friction. In the case of Edington, the sliders f must slide on the reaction member and will, to a considerable degree, slide in engagement with the portion of the reaction member which defines the outer edge of the groove in which the sliders slide. In the case of Benson et al., it would appear that the rollers would roll smoothly between the eccentric member 4 and the ring 10 therearound. In fact, however, because the rollers on the ends of the piston rods must roll back and forth along the surface of the reaction member 4 during their rotation around the axis of rotation of the rotor 5, this will cause them to move in rubbing engagement with the inner surface of the ring 10. It will be understood that if one of the rollers is rolling along the surface of the eccentric member 4, for example in a clockwise direction around the eccentric member 4, the roller will be rolling counterclockwise, and the outer portion of the periphery thereof will be moving counterclockwise along the inner surface of the ring 10 and will rub against this surface rather than roll along it. This will of course create a great deal of friction.

At high speeds, the frictional forces in both of these prior art engines are extremely high, and make them impractical for use.

OBJECTS AND BRIEF SUMMARY OF THE INVENTION

It is an object of the present invention to provide a rotating cylinder block piston-cylinder engine of the type in which the piston rods are rigid with the pistons, which overcomes the problems of the prior art engines of this type.

It is a further object to provide such an engine in which the piston rods are engaged with the reaction member through differential rolling engagement means which permits free rotation along the reaction member, and yet which also permits free movement along the inner periphery of means for holding the engaging members against the reaction member.

To this end, the present invention provides a rotating cylinder block piston-cylinder engine which has a stator means, a hollow rotor housing rotatably mounted on the stator means for rotation around a rotor housing axis of rotation, a plurality of cylinders radially positioned in the peripheral wall of the hollow rotor housing, a piston slidable in each of said cylinders and having a piston rod rigidly mounted thereon and extending radially of the rotor into the hollow rotor housing, means connected to the cylinders and pistons therein for supplying a gas into the cylinders which is caused to expand for driving the pistons radially inwardly in the cylinders and for exhausting the expanded gas from the cylinders, a rotatable reaction member in the hollow rotor housing and rotatably mounted on the stator means for rotation around a fixed axis eccentric to the rotor housing axis of rotation and having peripherally extending inner and outer rolling surfaces around the periphery thereof, and differential rolling engagement means on the inner ends of each of said piston rods in rolling engagement with the surfaces on the rotatable reaction member for transmitting the force from the pistons to the reaction member and reaction force from the reaction member to the pistons, and for causing the reaction member to rotate.

Other and further objects of the invention will become apparent from the following detailed description.

BRIEF DESCRIPTION OF THE DRAWINGS

The invention will now be described in detail in connection with the accompanying drawings, in which.

DETAILED DESCRIPTION OF THE INVENTION

Figure 1:
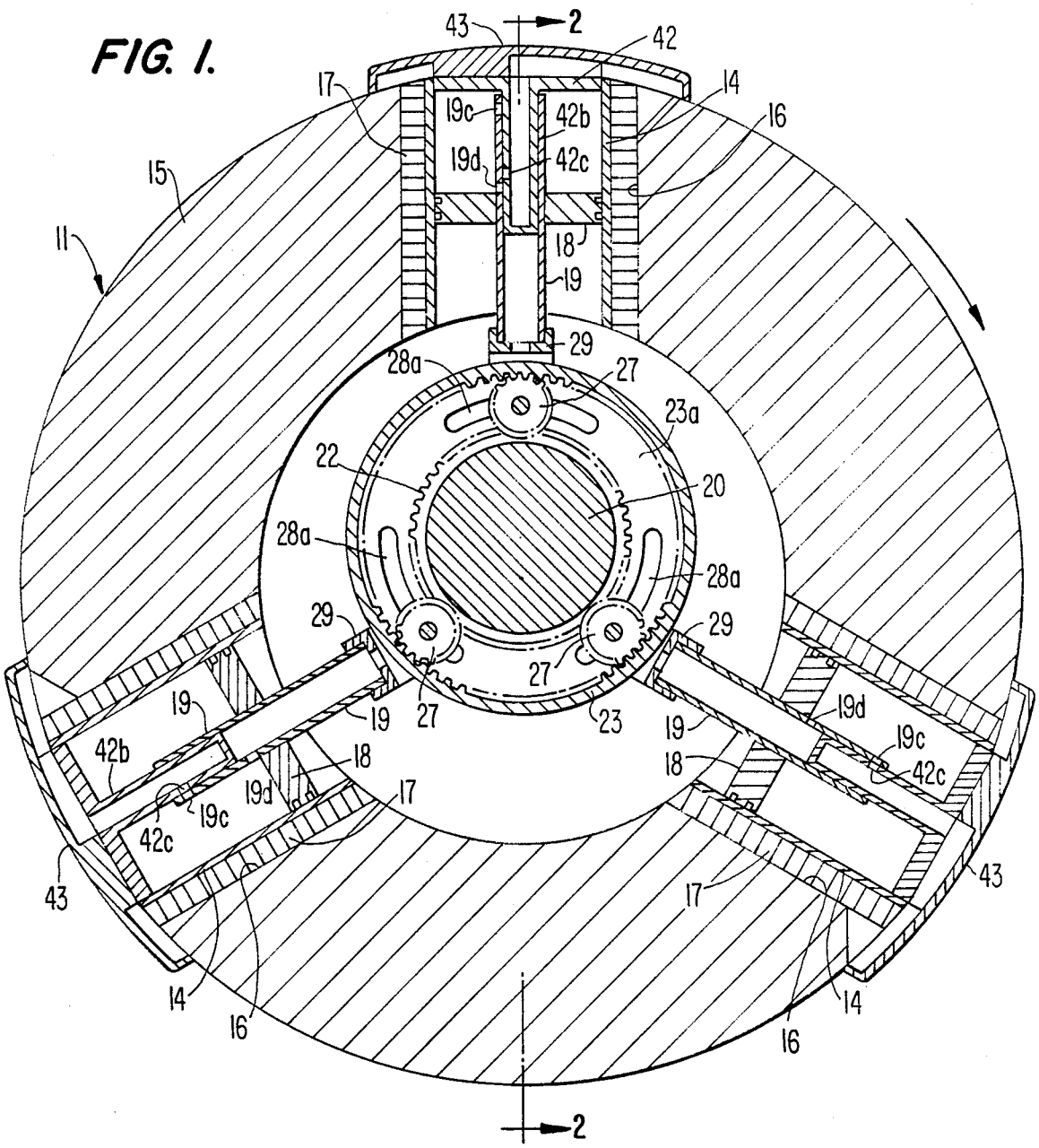
FIG. 1 is a transverse sectional view of the engine according to the invention, taken on line 1—1 of FIG. 2.
Figure 3:
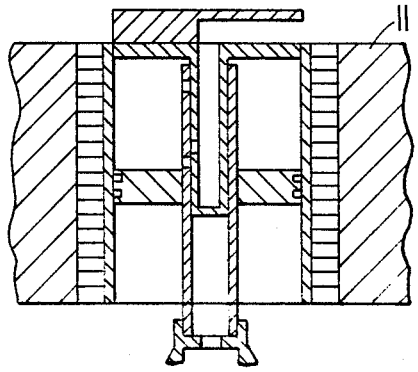
FIG. 3 is a detailed sectional view through one of the cylinders in the rotor of the engine of FIGS. 1 and 2.
Figure 2:
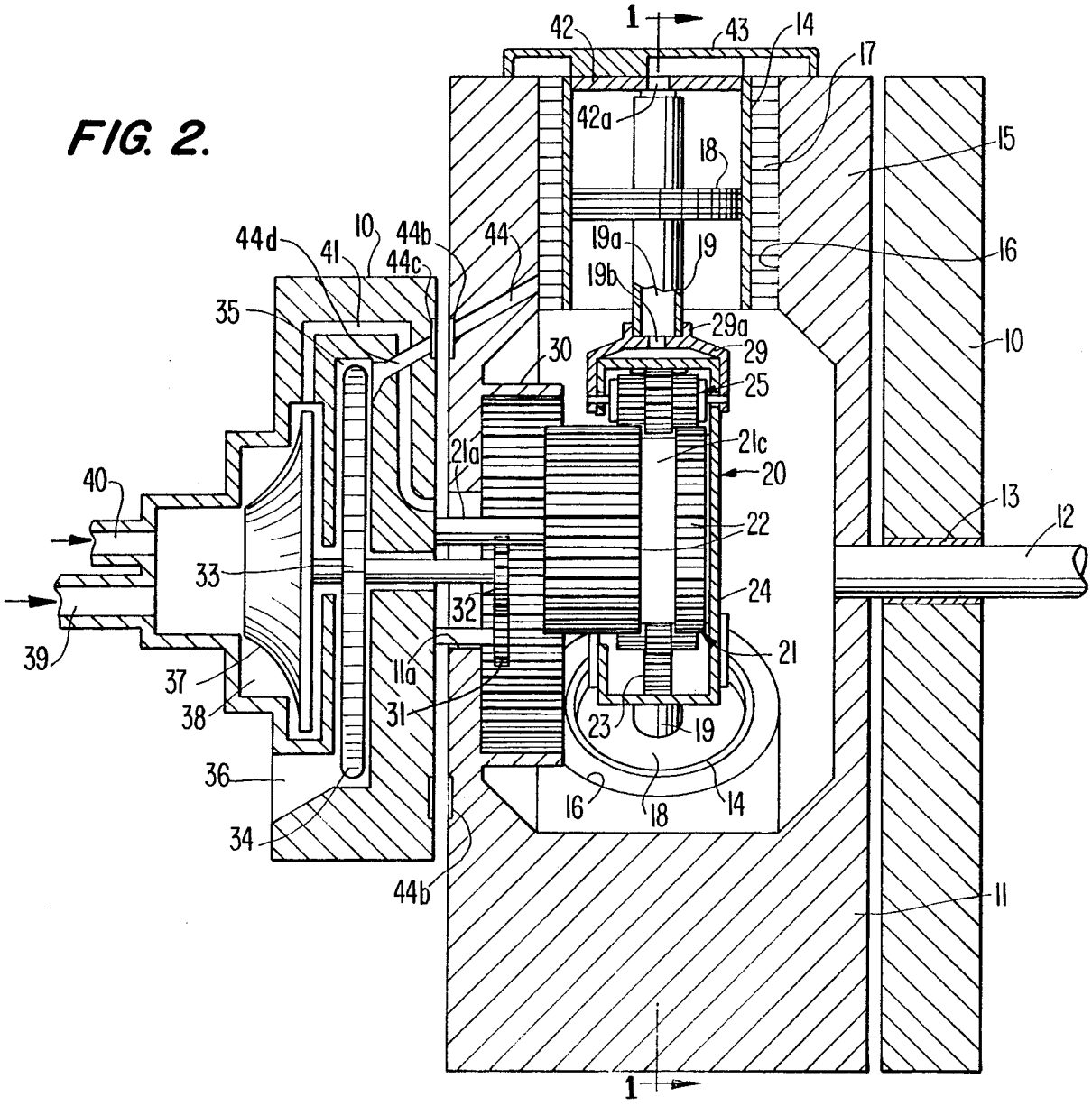
FIG. 2 is a longitudinal sectional view of the engine taken on line 2—2 of FIG. 1.
Figure 4:
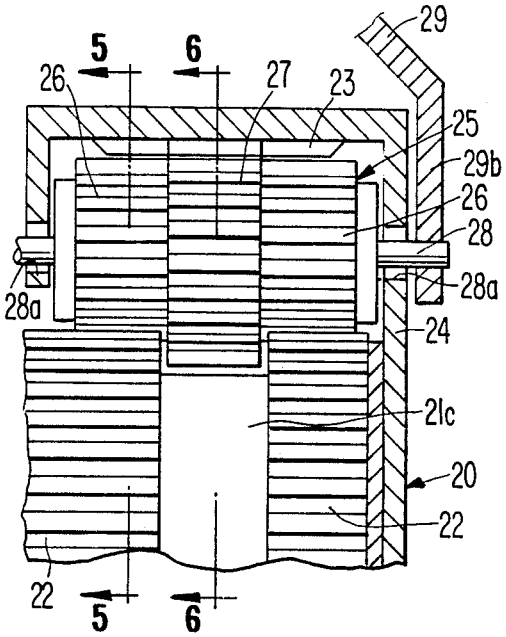
FIG. 4 is a partial sectional view, on an enlarged scale, of the gearing for connecting the piston rods to the reaction member.
Figure 5:
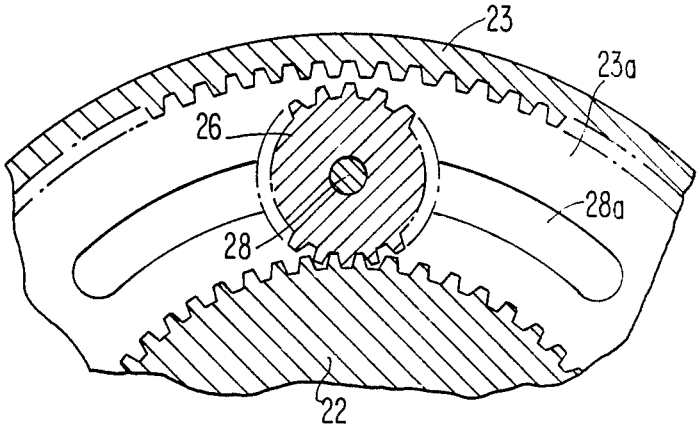
FIG. 5 is a partial sectional view taken along line 5—5 of FIG. 4.
Figure 6:
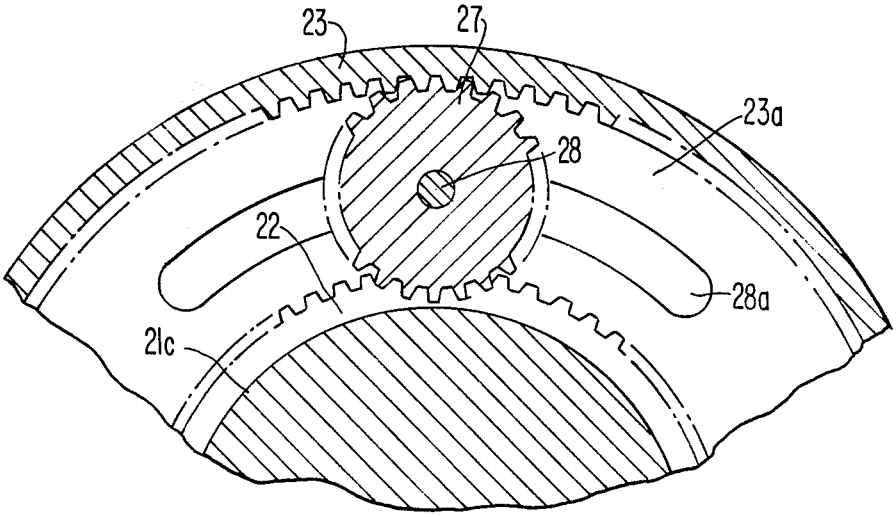
FIG. 6 is a partial sectional view taken along line 6—6 of FIG. 4.

The detailed description is of an internal combustion type engine, which is the best mode now contemplated of practicing the invention.

As seen in the drawings, the rotating cylinder block piston-cylinder engine of the present invention has a stator 10, shown schematically in two spaced parts, and a hollow rotor housing 11 rotatable relative to the stator 10 on a rotor shaft 12 mounted on the stator in a bearing 13. In actual practice, the stator is somewhat larger, and extends on both sides of the hollow rotor housing 11, but for the sake of simplicity, it is shown in the present drawings as the two simple blocks 10.

The rotor housing 11 has a plurality of cylinders 14 mounted therein nd extending radially of the axis of the rotor shaft 12. The present embodiment shows three such cylinders, but, depending upon the size of the rotor housing 11, there could be more. The cylinders 14 are mounted in radial bores 16 in the peripheral wall 15 of the rotor housing, and cooling fins 17 on the cylinders 14 extend to the wall of the bore 16, and mount the cylinder within the bore. As will be described in greater detail hereinafter, the fins 17 have apertures therein for permitting cooling fluid to pass not only circumferentially of the cylinders 14, but also longitudinally therealong. Where the engine is designed for use with gasoline or the like, ignition means, such as a spark plug (not shown) is provided in each cylinder. Where the fuel need not be ignited by a separate ignition means, as in the case of a Diesel type engine, the separate ignition means can be omitted.

Slidably mounted in each of the cylinders is a piston 18 having conventional piston rings for sealing the piston with the inner surface of the cylinder, and on each piston is a hollow piston rod 19 which is rigid with the piston 18 and which extends radially of the rotor housing 11. The hollow interior **19*a* of each piston rod is open, through an aperture 19*b* in a piston rod receiving fitting 29*a* of a saddle 29**, to be described later.

A reaction member 20 is provided in the hollow interior of the hollow rotor housing 11. The reaction member is constituted by a reaction rotor 21 rotatably mounted on a reaction rotor shaft **21*a* extending into the rotor housing from the stator part 10 on the left side of the rotor housing 11 in the drawing through a rotor housing opening 11*a*. In this embodiment, reaction rotor 21 has two sun-type gears 22 on the opposite axial ends thereof, separated by a groove 21*c***.

Surrounding the reaction rotor 21 is a ring gear 23 which is mounted on an axially extending portion of a connecting web 24 which rigidly connects the ring gear 23 with the sun-type gears 22. The outer peripheral surfaces of the sun-type gears 22 constitute an inner rolling engagement surface and the inner surface of the ring gear 23 constitutes an outer rolling engagement surface radially spaced from the gears 22. There is defined between the ring gear 23 and the sun gears 22 a generally annular space **23*a***.

Mounted within the annular space is a differential rolling engagement means which in this embodiment is a planet-type gear cluster 25 which is constituted by two rotor engaging planet-type gears which have the peripheries thereof meshed only with the peripheries of the sun-type gears 22, and a ring gear engaging planet-type gear 27 which is positioned between the two rotor engaging planet-type gears 26, and which is meshed only with the ring gear 23. The diameter of the rotor engaging planet-type gears 26 is slightly less than the radial dimension of the annular space **23*a*, so that the outer portions of the peripheries of the rotor engaging planet-type gears 26 do not mesh with and do not engage the ring gear 23. Likewise, the diameter of the ring gear 27 is such that the inner peripheral portion thereof is spaced from the bottom of the groove 21*c*, so that the outer portion of the periphery of the planet-type gear 27 does not engage the reaction rotor 21. The gears 26 and 27 are separately rotatably mounted on a gear cluster shaft 28 which projects axially outwardly of the web 24 at both ends through circumferentially extending slots 28*a* in the web 24**.

The saddle 29 mentioned hereinbefore, has radially inwardly extending legs **29*b* in which the ends of the gear cluster shaft 28 are rotatably mounted, so that the saddle in effect carries the planet-type gear cluster 25 rotatably thereon. Inasmuch as the saddle is rigid with the piston rod 19 by virtue of the engagement of the piston rod 19 in the piston rod receiving fitting 29*a*, the planet-type gear cluster 25 is mounted on the radially inner end of the piston rod 19**.

It will be appreciated that there is a planet-type gear cluster rigidly mounted on the radially inner end of each of the piston rods 19.

A timing ring gear 30 is mounted on the wall of the hollow rotor housing 11, and surrounds the portion of the sun-type gear 22 which projects axially beyond the saddles 29. The projecting portion of the sun gear 22 is meshed with the timing ring gear, and the engagement between these two gears keeps the rotation of the reaction member 20 in synchronism with the rotation of the hollow rotor housing 11.

A pair of power take-off gears 31 and 32 are positioned within the timing ring gear 30, and the gear 31 is mounted by a stub shaft on stator part 10. The radially innermost gear 32 is mounted on a power take-off shaft 33 which extends axially out of the rotor housing 11 through the rotor housing opening **11*a***.

Within an exhaust gas turbine chamber 35 provided in the left hand stator part 10 is mounted an exhaust gas turbine 34 which is connected to the power take-off shaft 33. Within an air intake impeller chamber 38 in the stator 10 and spaced axially from the exhaust gas turbine chamber 35 is an air intake pump impeller 37 which is mounted on the axial end of the power take-off shaft 33. Opening into the air intake impeller chamber 38 is an air intake port 39 and a fuel intake port 40. An air-fuel passage 41 extends from the periphery of the air intake impeller chamber 38 through the stator 10 to a position adjacent the reaction rotor shaft **21*a* and opposite the rotor housing opening 11*a***.

The outer end of each cylinder is closed by a cylinder cover 42*b* which has a hollow piston rod guide 42 extending downwardly into the cylinder therefrom, and an exhaust port 42*a* opening therethrough from the interior of the hollow piston rod guide 42*b*. An exhaust manifold 43 is mounted on the outside surface of the hollow rotor housing 11 over the exhaust port 42*a*, and conducts exhaust gas to the bore 16 in which the cooling fins 17 are positioned. The cooling fins have apertures therein for permitting the exhaust gas to flow not only peripherally around the cylinder 14 while being guided by the fins, but also to flow longitudinally of the cylinders 14.

The hollow piston rod 19 has an intake valve opening 19*d* therein just above the piston 18, and an exhaust valve opening 19*c* therein above the inlet opening 19*d*. The hollow piston rod guide 42*b* has an exhaust outlet 42*c* therethrough. In the positions of the pistons shown in FIG. 1, the inlet openings 19*d* in the two lower pistons are exposed to the hollow interior 19*a* of the piston rod 19, and the exhaust openings 19*c* are aligned with the openings 42*c* in the hollow piston rod guide 42*b*, in positions for fuel intake and exhaust of the cylinders. The piston at the top of FIG. 1 is in the top dead center position, in which the cylinder is closed, ready for the firing of the ignition means.

Extending through the hollow rotor housing 11 from the radially inner ends of each of the cylinder containing bores 16 are exhaust passages 44 extending to an end surface of the hollow rotor housing 11 and opening into an annular groove 44*b* thereon. Opposed to the annular groove 44*b* on the opposed wall of the stator portion 10 is a second annular groove 44*c*, from which an exhaust passage extension 44*d* extends into the exhaust gas turbine chamber 35. An exhaust gas discharge 36 is provided in the stator 10 opening out of the exhaust gas turbine chamber 35.

It will be understood that the shapes of the various chambers, turbines, ports and passages are shown generally, and in a practical embodiment of the engine may have different sizes and shapes from those shown in the drawings. Moreover, the rotor housing 11 is closely spaced to the stator 10 so that the annular grooves will transmit the exhaust gas across the joint between the rotor housing and the stator. Gaskets, not shown, may be provided adjacent the annular grooves to prevent escape of exhaust gas.

In operation, a mixture of fuel and air from the fuel intake port 40 and the air intake port 39 are pumped by the air intake impeller 37 through the air fuel passage 41 and through the rotor housing opening 11*a* into the hollow interior of the hollow rotor housing 11. When the intake opening 19*d* in the respective piston rods 19 is opened, the fuel-air mixture is drawn through aperture 19*b* and the hollow interior 19*a* of the piston rod and into the cylinder, and as the rotation of the rotor housing continues to move the cylinder to the position of the upper cylinder in FIG. 1, the air-fuel mixture is compressed. Then at the appropriate rotational position, the mixture is ignited by the ignition means to drive the piston 18 radially inwardly. The force transmitted radially along the piston rod 19 is transmitted to the gear cluster 25 through the saddle 29 and the gear cluster shaft 28, and through the sun-type gears 22 against the reaction rotor 21. The reaction force is transmitted back through the system, and as the piston moves, for example to the position of the lower right piston in FIG. 1, the lateral component, due to the offset of the radial movement of the piston from the eccentric axis of the reaction member, causes a rotational force to be exerted on the rotor housing 11, to rotate it.

As will be seen, the fact that the piston rods are rigidly engaged with the pistons causes them to shift in the direction of rotation (shown by the arrow in FIG. 1) along the peripheral surface of the reaction rotor 21. The maximum forward shift is at about the position of the lower right-hand piston shown in FIG. 1. Thereafter, as the piston moves around the axis of rotation of the rotor, to about the bottom position in FIG. 1, the end of the piston rod will move in the opposite direction relatively to the surface of the reaction rotor 20. This will continue to substantially the position of the lower left-hand piston in FIG. 1, after which the movement of the piston with the rotor will cause the end of the piston rod to move forwardly in the direction of rotation until the piston returns to the top position as shown in FIG. 1.

Since the rotor engaging planet-type gears 26 are freely rotatable on the gear cluster shaft 28, and the shaft 28 is movable in the slots 28*a*, the gears 26 are free to roll along the sun-type gears 22 during this relative movement.

It will be appreciated that as gears 26 are rotated, they are free of any contact with the axially extending portion of the connecting web 24 on which the ring gear 23 is mounted.

On the other hand, the ring gear engaging planet-type gear 27, which is engaged with the ring gear 23, is free to rotate relative to the rotor engaging planet-type gears 26, and will accordingly freely roll along the ring gear 23.

Thus, the planet-type gear cluster permits the rotor engaging planet-type gears 26 and the ring gear engaging planet-type gear 27 to roll freely in gearing engagement along the respective sun gears 22 and ring gear 27, regardless of the direction of rotation of the respective gears in the gear cluster 25. The axially extending portion of the web 24 thus keeps the rotor engaging planet-type gears 26 in engagement with the sun-type gears 22 at all times so as to properly transmit the reaction forces, yet there is no friction, other than normal gear friction, because of the outer peripheral portions of these gears rotating in the opposite direction relative to the ring gear. The ring gear engaging planet-type gear 27, being free to rotate independently of the gears 26, ensures that there is no undue frictional force, despite the presence of the forces containing the gear cluster so as to hold the gears 26 against the sun gears 22.

The exhaust gases from the respective cylinders will be transmitted through the exhaust ports 19*c* and 42*c* into the exhaust manifolds 43, and will circulate through the bores 16, guided by and past the fins 17, and out through the exhaust passages 44. The exhaust passages 44 will discharge into the annular groove 44*b*, and then into the annular groove 44*c* across the gap between the rotor and the stator, and the exhaust gas will flow through the passage 44*d* into the exhaust gas turbine chamber, where it will be directed against the blades of the turbine 34 to drive the turbine and transmit power to the shaft 33.

Further power is taken out from the system from the rotation of the reaction rotor 21 from the movement of the gears 26 therealong, through the timing ring gear 30 and the power take-off gears 31 and 32 to the shaft 33.

Other conventional motor structure can be incorporated, such as some means for starting the rotor housing 11 in its rotation at the start-up of the engine, and such things as speed controls etc. which are conventional for internal combustion engines can be incorporated.

Figure 7:
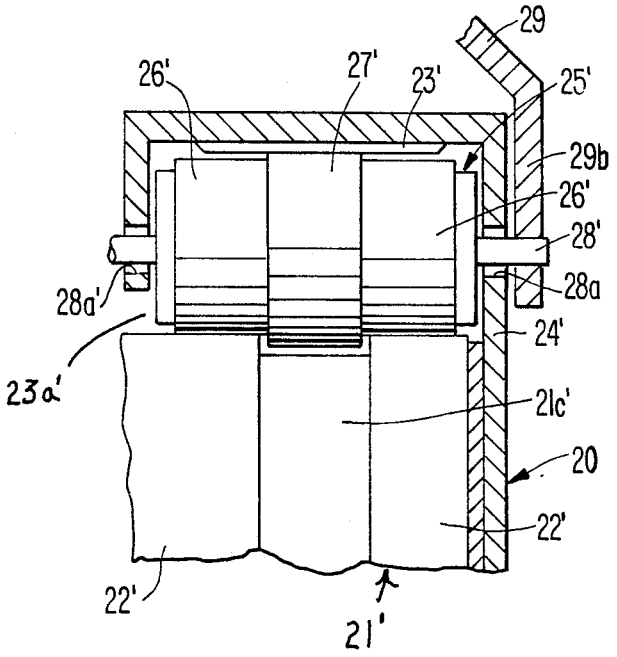
FIG. 7 is a view similar to FIG. 5 showing an alternative embodiment in which rollers are provided for engaging the piston rods with the reaction member.

While the gear cluster form of the differential rolling engagement means provides the best engagement between the ends of the piston rods and the reaction member, if the size of the engine is reduced, it becomes increasingly difficult and expensive to provide gears which have good precision and which are sufficiently strong to withstand the forces generated in the engine. Accordingly, an alternative form of the differential rolling engagement means can be a roller bearing or ball bearing means, as shown in FIG. 7. Small size high quality bearings of these types are readily available which can be substituted for the gears in the embodiment of FIGS. 1–6. To this end, the sun gears 22 on the opposite ends of the reaction rotor 21 are replaced on reaction rotor 21′ by simple cylindrical bearing surfaces 22′ separated by a groove 21*c*′. The ring gear 23 is replaced by a simple cylindrical bearing surface 23′ connected to the reaction rotor 21 by the web 24′, and the generally annular space 23*a*′ is provided between the bearing surfaces 22′ and 23′. The differential rolling engagement means is constituted by a roller cluster 25′ having a pair of roller bearings 26′ which have the peripheries thereof rolling on the bearing surfaces 22′ and a roller bearing 27′ which is positioned between the two roller bearings 26′ and which is in rolling engagement with the bearing surface 23′. As with the gear cluster, the diameter of the rotor engaging bearings is slightly less than the radial dimension of the annular space 23*a*′ so that the outer portions of the peripheries of the rotor engaging bearings 26′ do not engage the bearing surface 23′. Likewise, the diameter of the bearing 23′ is such that the inner peripheral surface thereof is spaced from the bottom of the groove 21*c*′ so that the outer portions of the periphery of the roller bearing 27′ does not engage the reaction rotor 21′. As with the embodiment of FIGS. 1–6, the roller bearings 26′ and 27′ are mounted on the shaft 28′.

The operation of this embodiment is the same as that of the embodiment of FIGS. 1–6, except that the engagement between the ends of the piston rods and the reaction member is a simple rolling engagement rather than a geared rolling engagement. However, the engine can be made in a much smaller size without the necessity of providing very expensive small precision gears for gear cluster arrangement of the embodiment of FIGS. 1–6.

While the differential rolling engagement means of both embodiments has been described as having two members engaging the outer peripheral surface of the reaction rotor 21 and one member between the two members and engaging the ring member 23 or 23′, it will be appreciated that by properly constructing the differential rolling engagement means, other arrangements are possible. For example, other numbers of members could contact the outer peripheral surface of the reaction rotor 21, and other numbers of members could engage the ring member 23 or 23′. Further, in the differential rolling engagement means, some of the members can be gears and others can be rollers.

While the foregoing embodiment has been described as an internal combustion engine operating with combustible fuel, the invention is not limited to this type of engine. The motor will operate equally well with a compressed gas which is expansible. In such case, the gas would be supplied through the air-fuel passage 41 into the hollow interior of the housing while under pressure, and passed through the opening 19*b* in the saddle 29 into the hollow piston, and through the intake opening 19*d* into the interior of the cylinder. At this point, the gas would then expand, driving the piston 18 inwardly. The depressurized gas would then be exhausted through the exhaust system similar to the products of combustion of the internal combustion engine.

It will be seen that the engine can be operated without any lateral movement of connecting rods between the pistons and a stationary crank, so that the engine can be driven at an extremely high rotational speed without any vibrations. This not only increases compression ratios etc. for internal combustion type engines, but increases the power per unit weight available from the engine. Vibrations are substantially eliminated, since the parts are moving only radially or in rotation, and there is no oscillating movement of any of the parts, with the exception of the slight rotational movement of the gear cluster 25 back and forth along the periphery of the reaction rotor 21. The engine runs extremely smoothly at very high speeds, which makes possible high power output.

What is claimed is:

1. A rotating cylinder block piston-cylinder engine, comprising:

a stator means;

a hollow rotor housing rotatably mounted on said stator means for rotation around a rotor housing axis of rotation;

a plurality of cylinders radially positioned in the peripheral wall of said hollow rotor housing;

a piston slidable in each of said cylinders and having a piston rod rigidly mounted thereon and extending radially of said rotor into said hollow rotor housing;

means connected to said cylinders and the pistons therein for supplying a gas into said cylinders which is caused to expand for driving pistons radially inwardly in said cylinders and for exhausting the expanded gas from said cylinders;

a rotatable reaction member in said hollow rotor housing and rotatably mounted on said stator means for rotation around a fixed axis offset from the rotor housing axis of rotation and having radially spaced peripherally extending rolling engagement surfaces around the periphery thereof; and differential rolling engagement means on the inner ends of each of said piston rods in rolling engagement with said rolling engagement surfaces for transmitting the force from said pistons to said reaction member and reaction force from said reaction member to said pistons and for causing said reaction member to rotate.

2. An engine as claimed in claim 1 in which at least some said rolling engagement surfaces have gearing thereon, and said differential rolling engagement means comprises gear means in mesh with said gearing.

3. An engine as claimed in claim 2 in which said peripherally extending rolling engagement surfaces on said rotatable reaction member includes gearing on said reaction member and ring gearing for holding said gear means in engagement with said gearing on said reaction member, and said gear means comprises gears freely rotatably engaged with said ring gearing and said gearing on said reaction member, whereby the ring gearing holds said gear means in engagement with said reaction member and said gear means is free to move along said gearing on said reaction member while the hollow rotor housing is rotating.

4. An engine as claimed in claim 2 in which said peripherally extending gearing on said rotatable reaction member comprises sun type gearing and ring gearing spaced outwardly thereof, and said gear means comprises a gear cluster having independently rotatable gears respectively meshed with the sun type gearing and the ring gearing, whereby the ring gearing holds said gear means in engagement with said reaction member and said gear means is free to move along the peripherally extending gearing while the hollow rotor housing is rotating and there is little friction between the gearing and the reaction member.

5. An engine as claimed in claim 4 in which said sun type gearing comprises two sun gears spaced axially along said reaction member and having a groove therebetween, and said gear cluster comprises a pair of gears meshed only with the respective sun gears and a further gear therebetween meshed only with said ring gearing and having the periphery thereof extending into said groove and spaced from the bottom of said groove.

6. An engine as claimed in claim 4 in which said gear cluster has a shaft on which said rotatable gears are independently rotatably mounted, and said engine further comprises a saddle on the end of each piston rod in which the ends of said gear cluster shaft are mounted for mounting said gear cluster on the piston rod.

7. An engine as claimed in claim 1 in which said means for supplying gas to said cylinders and pistons comprises means for supplying a combustible gas.

8. An engine as claimed in claim 7 in which said means for supplying combustible gas comprises an intake pump means for drawing in air and a combustible gas, and means for feeding the air and combustible gas from said pump means into the hollow interior of said rotor housing, and said piston rods are hollow and are open to the interior of said rotor housing, and include valve means for opening and closing said cylinders during reciprocation of said pistons for feeding the air and combustible gas into said cylinders.

9. An engine as claimed in claim 8 further comprising a power takeoff shaft to which said rotor housing is connected and which is rotated by rotation of said rotor housing, and said pump means is an impeller mounted on said power takeoff shaft.

10. An engine as claimed in claim 1 further comprising a power takeoff shaft to which said rotor housing is connected and which is rotated by rotation of said rotor housing.

11. An engine as claimed in claim 10 in which said rotor housing has a ring gear thereon concentric with the axis of rotation of the rotor housing, and a gear train between said ring gear and said power takeoff shaft.

12. An engine as claimed in claim 2 in which said rotor housing has a ring gear thereon concentric with the axis of rotation of said rotor housing, and said gearing on the periphery of said reaction member is meshed with said ring gear for keeping the timing of the rotation of said reaction member and said rotor housing in synchronism.

13. An engine as claimed in claim 1 further comprising a power takeoff shaft, an exhaust gas turbine on said power takeoff shaft, and conduit means extending from said cylinders to said gas turbine for directing exhaust gas from said cylinders against said turbine.

14. An engine as claimed in claim 13 in which said means for supplying gas to said cylinders comprises an impeller means on said power takeoff shaft for drawing in air and a combustible gas and means for feeding the air and combustible gas from said impeller means into the hollow interior of said rotor housing and then into said cylinders.

15. An engine as claimed in claim 1 in which at least some of said rolling engagement surfaces are bearing surfaces, and said differential rolling engagement means comprises rolling type bearings in rolling bearing engagement with said bearing surfaces.

16. An engine as claimed in claim 15 in which said peripherally extending rolling engagement surfaces on said rotatable reaction member includes inner roller bearing surface means on said reaction member and outer roller bearing surface means spaced outwardly thereof for holding said roller type bearings in engagement with said roller bearing surface means on said reaction member, and said roller type bearings comprise roller bearings freely rotatably engaged with said roller bearing surface mean, whereby said outwardly spaced roller bearing surface means holds said roller bearings in engagement with said reaction member and said roller bearings are free to move along said roller bearing surface means on said reaction member while the hollow rotor housing is rotating.

17. An engine as claimed in claim 16 in which said peripherally extending roller bearing surfaces on said rotatable reaction member comprises a cylindrical bearing surface and a further cylindrical bearing surface spaced outwardly thereof, and said roller type bearings comprise a roller bearing cluster having independently rotatable roller bearings respectively engaged with the cylindrical bearing surfaces, whereby the further cylindrical bearing surface holds said roller bearings in engagement with said reaction member and said roller bearings are free to move along the peripherally extending cylindrical bearing surfaces while the hollow rotor housing is rotating and there is little friction between the roller bearings and the reaction member.

18. An engine as claimed in claim 17 in which said cylindrical bearing surface comprises two portions spaced axially along said reaction member and having a groove therebetween, and said roller bearing cluster comprises a pair of roller bearings engaged only with the respective cylindrical bearing surface portions and a further roller bearing therebetween engaged only with said further cylindrical bearing surface and having the periphery thereof extending into said groove and spaced from the bottom of said groove.

19. An engine as claimed in claim 17 in which said roller bearing cluster has a shaft on which said roller bearings are independently rotatably mounted, and said engine further comprises a saddle on the end of each piston rod in which the ends of said roller bearing cluster shaft are mounted for mounting said roller bearing cluster on the piston rod.

* * * * *